United States Patent [19]

Wehling

[11] 4,343,431

[45] Aug. 10, 1982

[54] CENTRIFUGAL SEPARATOR

[75] Inventor: Holger Wehling, Solna, Sweden

[73] Assignee: Alfa-Laval AB, Tumba, Sweden

[21] Appl. No.: 183,943

[22] Filed: Sep. 4, 1980

[30] Foreign Application Priority Data

Sep. 5, 1979 [SE] Sweden ..... 7907385

[51] Int. Cl.[3] ..... B04B 1/14

[52] U.S. Cl. ..... 233/20 A

[58] Field of Search ..... 233/20 R, 20 A, 19 R, 233/19 A, 16, 17, 21, 27, 28, 1 R, 46, 47 R

[56] References Cited

U.S. PATENT DOCUMENTS 3,990,632 4/1976 Hemfort ..... 233/20 R 4,143,806 3/1979 Moriguchi ..... 233/20 A

*Primary Examiner*—Robert W. Jenkins

*Attorney, Agent, or Firm*—Cyrus S. Hapgood

[57] ABSTRACT

This invention relates to centrifugal separators of the kind having sludge ports at the rotor periphery to be opened during operation and separate outlets for separated heavier liquid phase and separated lighter liquid phase. To reduce the losses of valuable lighter liquid phase during total discharge or partial discharge of the separator by opening the sludge ports, the centrifuge is provided with an overflow device connected to the heavy phase outlet, said overflow device having an inner annular overflow and also having a number of passages at a larger diameter than the inner overflow border. The passages are dimensioned to let through all heavier liquid phase in normal operation but not to let through an increased amount of heavier liquid phase fed to the separator just before opening the sludge ports for the purpose of displacing the interface between the heavier and the lighter liquid phase towards the rotor axis to a level that corresponds to said inner overflow border. In order to push the interface between the liquid phases inwards before discharge, no other action is therefore needed than an additional supply of the heavier liquid phase.

3 Claims, 3 Drawing Figures

CENTRIFUGAL SEPARATOR

THE DISCLOSURE

Figure 3:
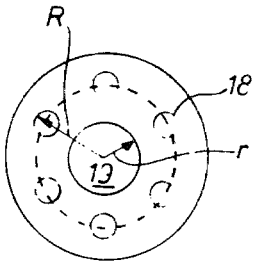

The present invention relates to a modification of a centrifugal separator of the kind having two separate liquid outlets for a relatively lighter separated liquid phase and a relatively heavier separated liquid phase and also having sludge ports at the rotor periphery to be opened during operation for ejecting separated heavier components.

More particularly, the invention relates to a modification of said separator for the purpose of reducing the losses of the light phase being unavoidably connected with total discharge and often also in connection with partial discharge.

In a common separator of the kind noted above, an interface is formed during operation between the separated light liquid phase and the heavy liquid phase. A usual method for controlling the radial position of the interface is to use overflows in the outlet chambers for the two liquid phases, said overflows being easily controlled by means of replaceable elements, namely, so-called level rings for the light liquid phase and gravity discs for the heavy liquid phase.

Liquid level control will be discussed below in context with the common separation process which consists in cleaning a valuable lighter liquid phase from possibly intermixed heavier liquid phase and sludge. One example is the cleaning of lubricating oils from water and solid particles.

In separators used for this purpose, so-called total discharge is a usual way of operating, meaning that the entire liquid content in the rotor is ejected together with collected sludge when the sludge ports are opened. Thus, all light phase inside the interphase is obviously lost with the heavier contaminations. One way to reduce the losses of light phase would be to arrange said level rings and gravity discs so that the interphase is located far towards the center (axis) of the rotor. However, it is well known that this will impair the separation quality with respect to the light phase, and consequently the perfect approach is to locate the interface relatively far out from the center during operation and to displace the same radially inwards before discharge.

In a method already practiced for displacing the interface inwards before the opening of the sludge ports, the outlet for the heavier liquid phase is closed and an additional amount of heavy phase is added to accelerate the inward displacement of the interface. However, this method requires a control system which, in the discharge operations, controls valves on both the inlet side and the outlet side.

One object of the present invention is to provide a centrifugal separator of the above-mentioned kind in which the interface between the lighter and the heavier liquid phase at total discharge or partial discharge can be displaced inward toward the rotor axis without the need for any valve action on the outlet side.

According to the invention, this object has been achieved in a centrifugal separator having a rotor with a central inlet for a mixture to be centrifuged, sludge ports at the periphery of the separation chamber to be opened during operation to intermittently eject heavier components separated from said mixture, a first outlet chamber communicating with the separation chamber and including outlet means, such as paring means, to remove separated relatively lighter liquid phase, and a second outlet chamber communicating with the separation chamber through an annular overflow device, said second outlet chamber including an outlet device, such as paring means, to remove separated relatively heavier liquid phase. The invention is characterized in that said annular overflow device comprises passages located at an outer level with respect to the rotor axis and also an inner overflow located closer to the rotor axis, said passages being dimensioned to let through all heavier liquid phase in normal operation but not to let through an increase in heavier liquid phase that is added to the separator before the opening of said sludge ports for the purpose of displacing the interface between the heavier and the lighter liquid phase towards the rotor axis to a level corresponding to said inner overflow.

The modification according to the invention can easily be achieved in existing separators by replacing the above-mentioned gravity disc having only one central aperture by a gravity disc in which the central aperture has a radius corresponding to the desired level of the interface between light phase and heavy phase immediately before discharge, said gravity disc further being provided with a number of apertures located on a larger radius corresponding to the desired level for the interface during the separation operation between the discharges.

The invention can be applied to any centrifuge having separate outlets for lighter liquid phase and heavier liquid phase. If in such a centrifuge the outlet device for the light phase (for example, a paring disc) is designed to remove light phase at a radius larger than the level to which the heavy phase is brought before discharge and being determined by the inner annular overflow for the heavy phase, it is obvious that an unlimited additional supply of heavy phase for discharge may cause the heavy phase to reach the light phase outlet and contaminate the light phase separated out. Thus, in this general case the amount of additional heavy phase to be supplied must be limited so that the heavy phase never reaches the light phase outlet.

In order to completely eliminate the risk of heavy phase reaching the light phase outlet before discharge, the centrifuge according to an advantageous embodiment of the invention is provided with an overflow border known per se (a so-called level ring) between the outlet chamber for light phase and the separation chamber. Then such a radius for the inner overflow of the gravity disc can be selected that the interface between light phase and heavy phase can never reach said overflow border, i.e., so that a certain layer of light liquid phase will always remain in the inner part of the separation chamber irrespective of the amount of additional heavy phase supplied.

Figure 2:
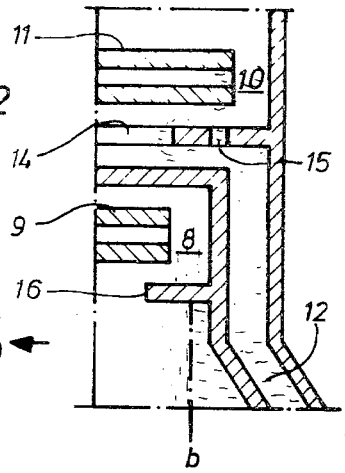
Figure 1:
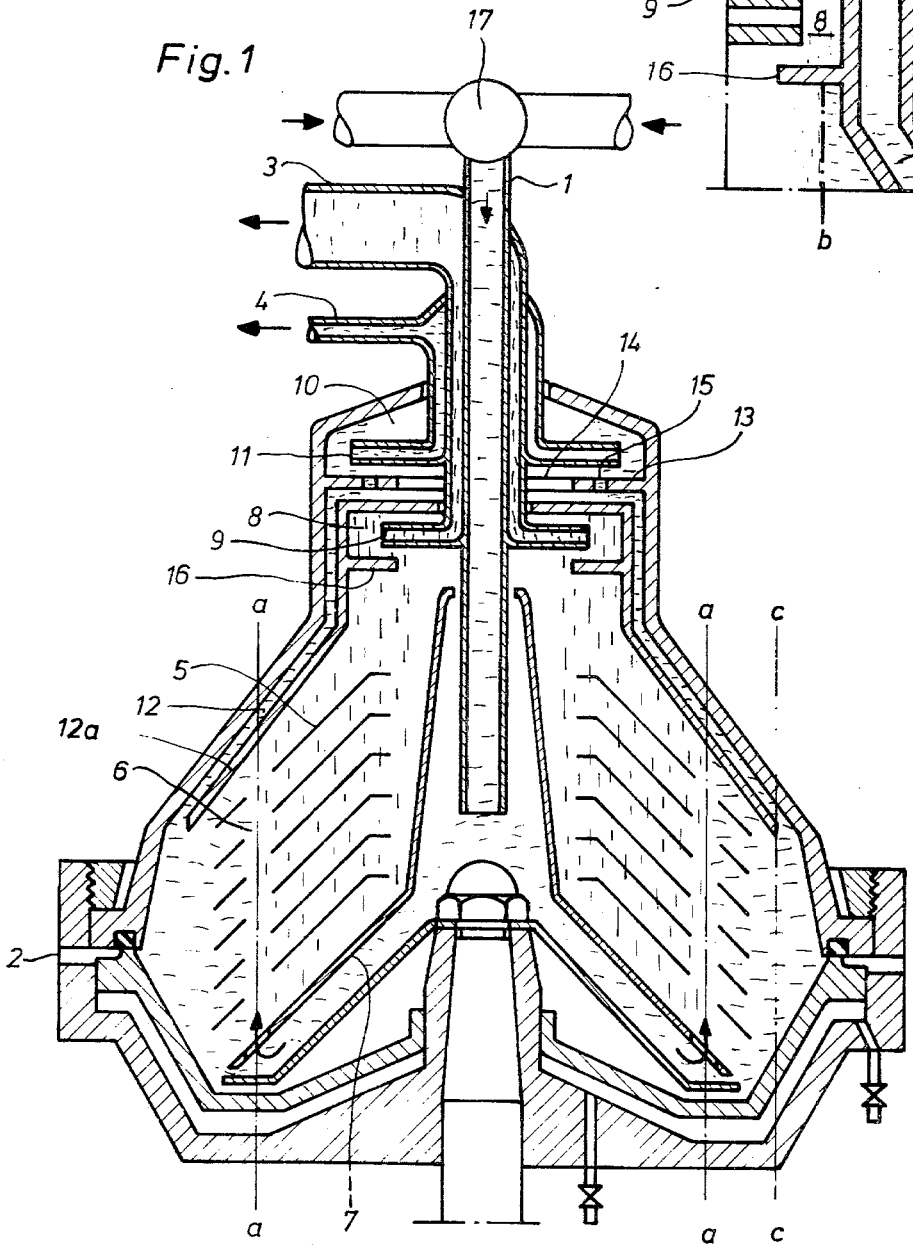

The invention will be further described below by means of an embodiment shown as an example in the accompanying drawing, in which FIG. 1 is a vertical sectional view of a separator modified according to the invention;

FIG. 2 is an enlarged detail view of the centrifuge according to FIG. 1, showing the liquid levels after interface displacement before discharge; and FIG. 3 is a schematic view of a gravity disc designed according to the invention.

The centrifuge rotor shown in FIG. 1 has a central inlet 1 for the mixture to be separated into three components, i.e., one sludge phase intermittently ejected through sludge ports 2 at the rotor periphery, one lighter liquid component discharged through an outlet 3 and one heavier liquid component discharged through an outlet 4. The rotor is further provided with a number of conical discs 5 having apertures 6 at a certain diameter to form axial distribution conduits for the liquid mixture added from the central inlet 1 through corresponding apertures in the distributor 7.

An outlet chamber 8 for separated lighter liquid phase communicates with the inner part of the separation chamber and is provided with a paring means 9 communicating with the outlet 3. Another outlet chamber 10 is provided with paring means 11 to take out heavier liquid phase to the outlet 4 and communicates with the separation chamber through passages 12 formed between the so-called top disc 12*a* and the rotor wall at a level c-c determined by the outer diameter of said top disc.

Between the passages 12 and the outlet chamber 10 an overflow 13 is provided for separated heavier liquid phase. The overflow 13 comprises both a central opening 14 and a number of apertures 15 located at a larger diameter than said central opening, the apertures 15 being dimensioned to let through all separated heavier liquid phase during normal operation. The overflow device 13 can simply be an easily exchangeable disc so that its overflow openings can be quickly changed with respect to size as well as radial position.

The repressing of the light phase before the discharge through the sludge ports 2 is carried out as follows. During the separating operation the interface between light phase and heavy phase is supposed to take the radial position a-a shown in FIG. 1. The apertures 15 in the overflow device for the heavy phase are sufficient only to drain all the separated heavy phase being fed to the separator in the form of an unseparated mixture through the inlet 1. Before a discharge operation is initiated by opening the sludge ports 2, an additional amount of heavy liquid is added, as by shifting the inlet valve 17 so that the supply of unseparated mixture is interrupted and a supply line for heavy phase is opened. Thus, inlet valve 17 serves as a means for intermittently supplying said additional amount of heavy liquid phase to the separating chamber. In the case where oil is cleaned from water and sludge, pure water can thus be added.

When the discharge operation is initiated, the interface is supposed to take the radial position b-b in FIG. 2. The overflow border 16 in the separation chamber and the inner overflow 14 to the outlet chamber 10 for heavy phase have such interrelated radial positions that the interface b-b cannot reach the border 16.

The gravity disc shown in FIG. 3 can be used in a centrifuge to modify the same according to the invention. The apertures 18 at the radius R and the central opening 19 at the radius r correspond to the apertures 15 and inner overflow 14 in FIG. 1.

Although the invention can be applied with special advantage in cases where there is to be total discharge of the centrifuge, the invention can also be used to advantage where there is only a partial discharge. As soon as the liquid-sludge amount ejected at each discharge operation is large enought to bring the interface between light phase and heavy phase after discharge to at least the same radius c-c as the outer diameter of the top disc, a so-called liquid trap break will occur, which means that the light phase will flow through the passage 12 to the heavy phase outlet 10. The light phase losses and contamination of outgoing heavy liquid phase connected with such liquid trap break can be effectively avoided in a centrifuge modified according to the invention by means of exactly the same interface displacement procedure described above in a total discharge operation.

I claim:

1. A centrifugal separator comprising a rotor mounted for rotation about an axis and having a central inlet for a mixture to be centrifuged, the rotor also having a separating chamber for receiving said mixture and provided with peripheral sludge ports adapted to be opened intermittently for discharging heavier components separated from said mixture, the rotor also having a first outlet chamber communicating with the separating chamber and including outlet means for removing separated lighter liquid phase, the rotor also having a second outlet chamber and an annular overflow device through which said second outlet chamber communicates with the separating chamber, said second outlet chamber including outlet means for removing separated heavier liquid phase, said annular overflow device having passages located at an outer level relative to said rotation axis and also having an inner overflow edge located closer to said axis, said passages being dimensioned to pass all heavier liquid phase during normal operation of the separator but not to pass an increase in heavier liquid phase added to the separator before opening of said sludge ports, and means for intermittently supplying to the separating chamber said added heavier liquid phase, whereby said added heavier liquid phase acts to displace the interface level between the heavier and the lighter liquid phases radially inward in the separating chamber toward the rotation axis to a level corresponding to said inner overflow edge.

2. The separator of claim 1, in which said outlet means in the first and second outlet chambers are paring devices.

3. The separator of claim 1 comprising also an annular partition wall extending from the inner wall of the rotor toward its rotation axis, said wall blocking the communication between the separating chamber and said first outlet chamber for the lighter liquid phase to form an overflow border, said border being so positioned radially relative to said inner overflow edge for the heavier liquid phase that said heavier phase is prevented from streaming into the outlet chamber for the lighter liquid phase irrespective of the amount of additional heavy phase fed to the separator before the sludge ports are opened.

* * * * *